US005211293A

United States Patent [19]

Rossmoore

[11] Patent Number: 5,211,293

[45] Date of Patent: May 18, 1993

[54] BOOK CASE WITH SHELVES AT RANDOM LONGITUDINAL ANGLES

[76] Inventor: Howard Rossmoore, 1879 Fiesta Dr., Sarasota, Fla. 34231

[21] Appl. No.: 807,104

[22] Filed: Dec. 13, 1991

[51] Int. Cl.[5] ..... A47F 5/00

[52] U.S. Cl. ..... 211/42

[58] Field of Search ..... 211/134, 135, 42, 90, 211/186

[56] References Cited

U.S. PATENT DOCUMENTS

| | | | |
|---|---|---|---|
| 3,223,246 | 12/1965 | Daitch | 211/134 |
| 3,549,019 | 12/1970 | Wood et al. | 211/135 |
| 4,095,858 | 6/1978 | Hopf | 312/198 |
| 4,930,640 | 6/1990 | Edwards | 211/135 X |

*Primary Examiner*—Robert W. Gibson, Jr.

[57] ABSTRACT

Book case composed of a combination of a number of rigid flat surfaces of any material of sufficient strength to support the weight of books resting thereon that are either horizontal front to back or canted front to back, but are arranged at random angles longitudinally from horizontal to vertical and of random lengths, the longitudinal axes of said shelves being either parallel to the rear plane of the book case or at an angle away from that plane. The surfaces of such shelves extending away from the rear plane of the book case can be at angles going up, down, or horizontal. Sections of said book case can have the four sides, two ends, top and bottom, of greater depth than the majority of the shelves. By using one or more shelf variations as just described, unlimited designs are possible to store books of different sizes, as well as pictures, nick nacks, trophies, etc. and in so doing create art forms in three dimensions. Some sections can be duplicated, some angles can be duplicated, with the rigid, flat, non-horizontal surfaces providing inclined surfaces that enable gravity to keep the books properly stacked and the book covers protected by the weight of the book(s) adjacent to it. The distance between shelves and the length of the shelves can be varied to accommodate different size books and different quantities of books in any section. The use of shelves that protrude from the front plane of the book case provides additional book case storage space within the same wall space. The shelves of greater depth accommodate books of greater width.

11 Claims, 11 Drawing Sheets

BOOK CASE WITH SHELVES AT RANDOM LONGITUDINAL ANGLES

BACKGROUND OF THE INVENTION

A book case comprised of longitudinal shelves that are horizontal, that are at 45 degrees from horizontal, that are at angles between one and 44 degrees from the horizontal. Said book case can also include shelves that extend away from the frame which shelves can be at right angles to the rear of the book case, at 45 degrees to the rear of the book case, and at any angle from one to 44 degrees to the rear of the book case. Such shelves that extend away from the book case can also be horizontal, can be canted at an angle of 45 degrees up or down, and can be canted at any angle from one to 44 degrees up or down. Said book case can also include sections where the two side ends and the top and bottom of such section are deeper than the majority of the shelves. The book case can also be a combination of any or all of the previously mentioned variations.

DESCRIPTION OF THE PRIOR ART

In the prior art book cases are comprised of shelves that are either horizontal or at 45 degrees from horizontal, see U.S. Pat. No. 4,095,858, whereas the instant invention is comprised of shelves that are horizontal, 45 degrees from horizontal, one to 44 degrees from horizontal, as well as shelves that extend out from a plane that is parallel to the rear of the book case, such extended shelves being horizontal, 45 degrees from horizontal up or down, and one to 44 degrees from horizontal up or down and can extend in a direction that is at right angles to the rear plane of the book case, in a direction 45 degrees from the rear plane of the book case, and in a direction from one to 44 degrees from the rear plane of the book case, can have sections of shelves or the entire shelf where the ends of such section as well as the top and bottom are deeper than the majority of the shelves that comprise the entire book case, and can be a combination of all the variations just described.

SUMMARY OF THE INVENTION

A combination of shelves at varying angles, some shelves being parallel to the rear of the book case and some extending out from the book case, all shelves being either horizontal, at 45 degrees from horizontal, and from one to 44 degrees from horizontal. Those shelves that extend out from the book case can extend horizontally at right angles, can extend at 45 degrees, and can extend at angles from one to 44 degrees. In addition to extending at the aforementioned different angles in a horizontal plane, such extended shelves can extend at an angle from horizontal, at 45 degrees and at angles from one to 44 degrees. Another variation would be a section of a shelf where the four sides of one shelf, two ends, a top and a bottom, are deeper than the majority of the shelves, the four sides thus protruding beyond the plane of the front of the book case. Any book case can include a combination of all the just described variations.

One of the objects for having the shelves at different angles, other than the fact that they look good is that it keeps the books from getting damaged when they are unsupported, since one book presses against another on the angled shelves, thus keeping it in shape. Another object for having the different angles is that having the shelf angles at less than 45 degrees decreases the pressure on the books at a lower elevation, thus making it easier to remove said books. Still a further object for having the books on other than a horizontal shelf makes for a happy medium in being able to read the titles on the edges of the books, since such titles are either at right angles to the edge, easy to read when the book is vertical, or parallel to the edge of the book, thus 90 degrees out of alignment for the easiest reading of the title. Still another object is achieved when the vertical distance between two shelves varies, allowing for books of varying sizes to be stored on one shelf, without a waste of space. A further object is to vary the right angle distance between shelves to accommodate different size books, thus minimizing the space requirement. Another object is achieved by the flexibility in using shelves at different angles both longitudinally and at right angles to the plane of the back of the book case, thus providing for an infinite variety of designs. The shelves that extend away from the plane of the book case parallel to the rear of the book case achieve two goals: provide additional storage space in a given length of wall and make reading of the book edge titles easier. Another object of having some shelf sections of different depth, in addition to providing still more design flexibility, is to accommodate books of greater width than the normal book width (or depth).

The material used need only be rigid flat surfaces of sufficient strength to accommodate the weight of books resting thereon and using a means of attachment compatible with the material used.

DETAILED DESCRIPTION OF THE PREFERRED EMBODIMENT

Figure 1:
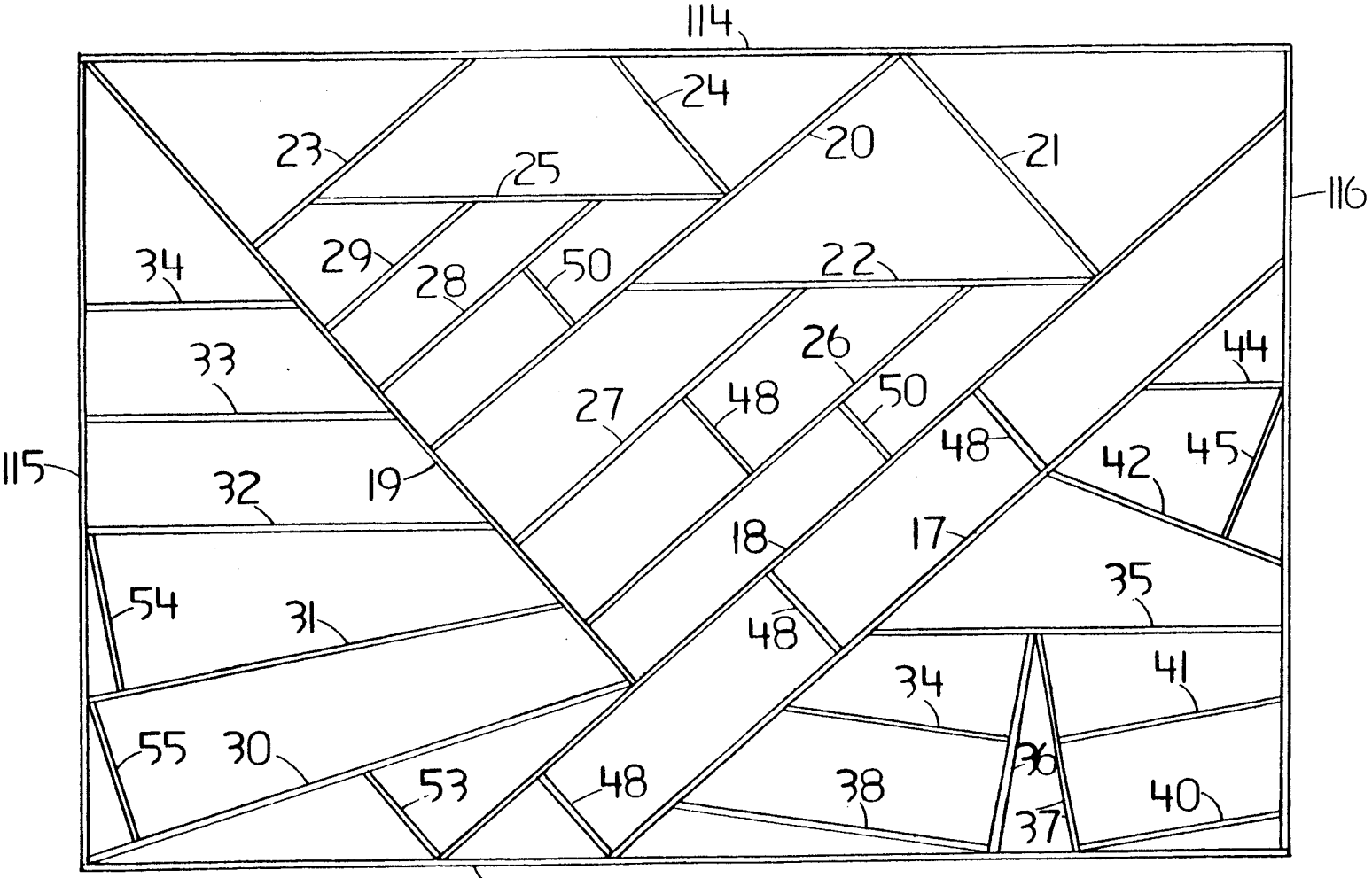
FIG. 1 is a front view of the preferred embodiment of the instant invention.

Referring to FIG. 1, the book case illustrated therein is made up of a frame with two vertical sides 116, and two horizontal sides 114, top and bottom, that contain a plurality of shelves that are either horizontal 22, 25, 32, 33, 34, 35, 44 or from one to 44 degrees from horizontal, namely: 17, 18, 19, 20, 21, 23, 24, 26, 27, 28, 29, 30, 31, 36, 37, 38, 39, 40, 41, 42, 44, 45, 48, 50, 53, 54, 55.

Shelf 17 is attached to bottom 114 and side 116 at an angle such that shelves 35 (horizontal), 42, and 44 (horizontal) fit when attached to both shelf 17 and side 116. Shelf 18 is attached to bottom 114 and side 116 parallel to shelf 17 and at a distance the length of shelf 48 from shelf 17, these three shelves 48 being attached to shelves 17 and 18 and at right angles to them. Shelf 45 is attached at right angels to shelf 42 in a position to meet side 116 where shelf 44 meets side 116.

Shelf 37 is attached to shelf 35 and bottom 114 in a position such that when shelves 40 and 41 are attached between 37 and side 116, 40 and 41 will be at right angles to 37 with shelf 40 meeting 37 where 37 meets 114. Shelf 36 is attached to shelf 35 and bottom 114 in a position such that when shelves 38 and 39 are attached between 36 and 17, 38 and 39 will be at right angles to 36 with shelf 38 meeting 36 where 36 meets 114.

Shelf 18 is attached to bottom 114 and side 116 parallel to shelf 17 and at a distance the length of shelf 48 from 17. Three shelves 48 are attached as follows: one where it meets 17, one where it meets 42 and one inbetween those two 48's and all these shelves 48 are at right angles to both 17 and 18.

Shelf 19 is attached at the upper corner where top 114 and side 116 meet and shelf 18 such that 19 is at right angles to 18. Shelf 20 is attached to top 114 and shelf 19 at right angles to 19 and at a distance from 18 equal the length of shelves 50 plus 48 plus 48 plus twice the thickness of the shelf material. Shelf 21 is attached to top 114 and shelf 18 and at right angles to 18. Shelf 22 is attached to shelf 18 and shelf 20 and is horizontal.

Shelf 26 is attached to shelves 19 and 22 and parallel to shelf 18 at a distance the length of shelf 50 which is attached to shelves 18 and 26 at right angles to both and at a point between shelves 22 and 19. Shelf 27 is attached to shelves 19 and 22 and parallel to shelf 26 at a distance the length of shelf 48 which is attached to shelves 26 and 27 at right angles to both and at a point between shelves 19 and 22.

Shelf 23 is attached to shelf 19 and top 114 and at right angles to 19 at a distance from shelf 27 equal to twice the length of shelf 48 plus twice the length of shelf 50 plus three times the thickness of the shelf material. Shelf 25 is attached to shelves 23 and 20 and is horizontal. Shelf 24 is attached to top 114 and shelf 20 at right angles to shelf 20 and meeting shelf 20 where shelf 25 meets shelf 20.

Shelf 28 is attached to shelf 19 and shelf 25 parallel to shelf 20 and at a distance from 20 equal the length of shelf 50 which is attached to shelves 20 and 28 between shelves 19 and 25 and at right angles to shelf 20. Shelf 29 is attached to shelf 19 and shelf 25 parallel to shelf 28 and at a distance from 28 equal the length of shelf 48.

Shelf 30 is attached at the point where bottom 114 and side 116 meet and where shelf 19 meets shelf 18. Shelf 53 is attached to shelf 30 and the point where bottom 114 and shelf 18 meet and at right angles to shelf 18. Shelf 31 is attached to side 116 and shelf 19. Shelf 55 is attached to shelf 30 and the point where shelf 31 meets side 116 and at right angles to shelf 30.

Shelves 32, 33, 34 are all attached to shelf 19 and side 116 and all are horizontal. Shelf 54 is attached to shelf 31 and the point where shelf 32 meets side 116 and at right angles to shelf 31.

Figure 2:
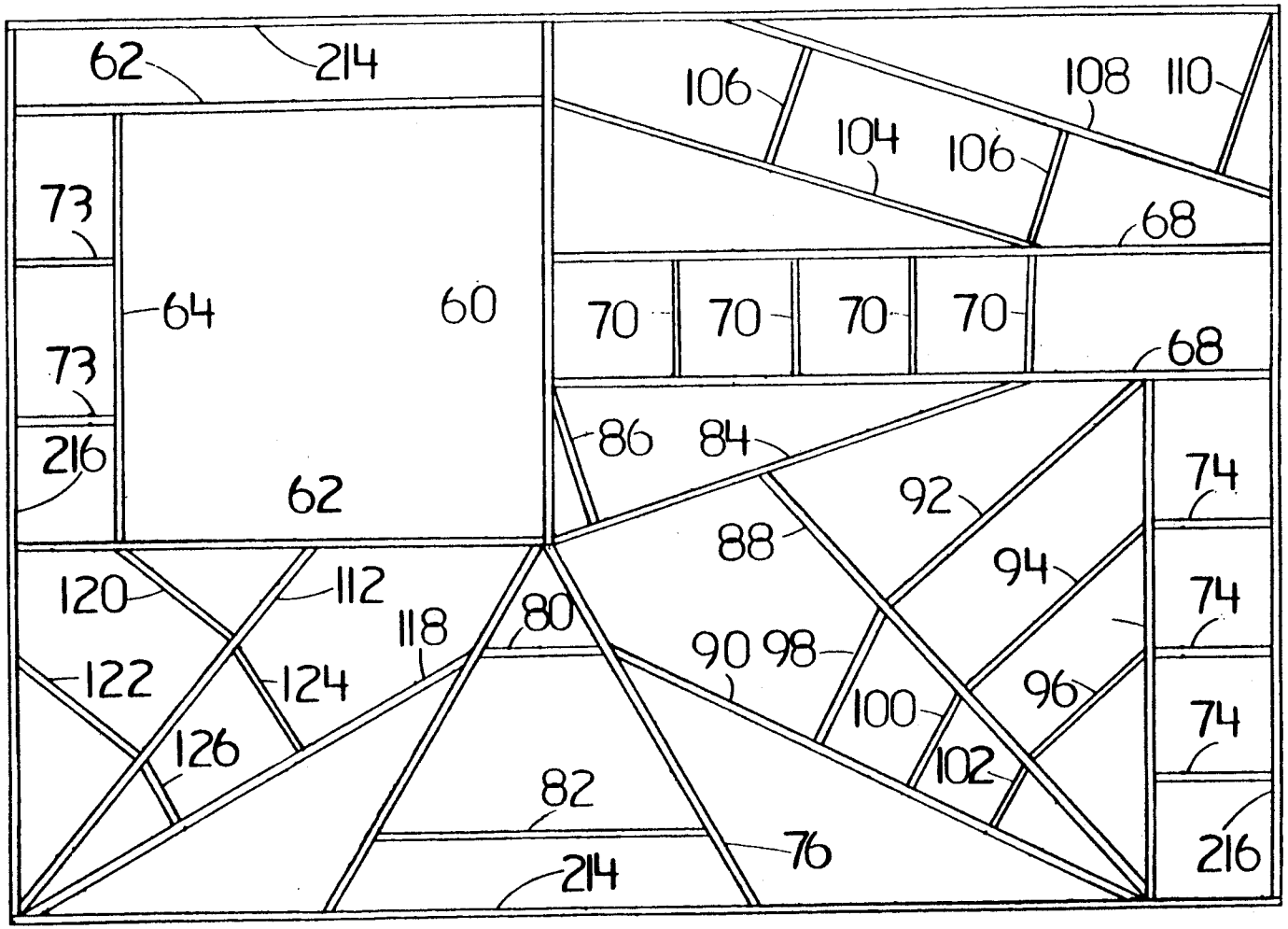
FIG. 2 is a front view of another embodiment of the instant invention.

Referring to FIG. 2, another embodiment of the instant invention is illustrated, is made up of a frame with two vertical sides 216, and two horizontal shelves 214, top and bottom, that contain a plurality of shelves that are either horizontal: 62, 68, 73, 74, 80, and 82; vertical: 60, 64, 70, and 73; or from one to 44 degrees from horizontal, namely: 76, 78, 84, 86, 88, 90, 92, 94, 96, 98, 100, 102, 104, 106, 108, 110, 112, 118, 120, 122, 124, 126.

Vertical side 216 is attached to top 214 and horizontal shelves 62 which in turn are attached to side 216. Vertical member 64 is attached to shelves 62. Two shelves 73 are attached to side 216 and vertical member 64 and are spaced equidistant between shelves 62. Two horizontal shelves 68 are attached to vertical member 60 and side 216 the distance equal the length of vertical members 70 from each other and such that they are equidistant from shelves 62. Four vertical members 70 are attached to shelves 68, at right angles to them and spaced at a distance equal to one-sixth the distance from vertical member 60 and side 216 with the last vertical member 70 to the right being two-sixths that distance from side 216.

Vertical member 72 is attached to lower shelf 68 and bottom 214 a distance equal the length of 74 from side 216. Three horizontal shelves 74 are attached to vertical member 72 and side 216.

Angled member 76 is attached where lower shelf 62 and vertical member 60 meet and to bottom 214. Member 78 is also attached where lower shelf 62 and vertical member 60 meet and to bottom 214 and at the same angle from the vertical as 76. Horizontal shelves 80 and 82 are attached to members 70 and 78. Shelf 84 is attached where lower shelf 62 and vertical member 60 meet and to shelf 68 where the furthest to the right of vertical members 70 meets 68. Member 86 is attached where shelf 68 and vertical member 60 meet and to shelf 84 and at right angles to shelf 84.

Shelf 88 is attached to the point where vertical member 72 and bottom member 214 meet and to shelf 84 at a position on shelf shelf 84 where if 88 were continued it would meet the intersection of the furthest left of vertical members 70 and horizontal shelf 68. Shelf 90 is attached to the point where vertical member 72 and bottom member 214 meet and to member 76 where 76 and horizontal member 80 meet.

Shelf 92 is attached where vertical member 72 and horizontal shelf 68 meet and to shelf 88 and at right angles to shelf 88. Shelf 94 is attached where vertical member 72 and the highest horizontal shelf 74 meet and to shelf 88, parallel to shelf 92 and at right angles to shelf 88. Shelf 96 is attached where vertical member 72 and middle horizontal shelf 74 meet and to shelf 88, parallel to shelf 92 and at right angles to shelf 88.

Shelf 98 is attached to shelf 88 where 92 meets 88 and to shelf 90, 98 being at right angles to shelf 90. Shelf 100 is attached to shelf 88 where 94 meets 88 and to shelf 90, 100 being at right angles to shelf 90 and parallel to shelf 98. Shelf 102 is attached to 88 where shelf 96 meets shelf 88 and to shelf 90, 102 being at right angles to shelf 90 and parallel to shelf 98.

Shelf 104 is attached to vertical member 60 where shelf 62 meets shelf 60 and to shelf 68 where the vertical member 70 furthest to the right meets shelf 68. Both members 106 are at right angles to shelf 104, are attached to shelves 104 and 108, one 106 meeting 104 where 104 meets shelf 68 and the other 106 being between that 106 and vertical member 60. Shelf 108 is parallel to shelf 104, is attached to two members 106, side 216 and top 214. Member 110 is at right angles to shelf 108, is attached to 108 and the point where side 216 meets top 214.

Shelf 112 is attached where bottom 214 and left side 216 meet and to shelf 62 midway between where vertical members 60 and 64 meet 62. Shelf 118 is attached where bottom 214 and left side 216 meet and to member 78 where shelf 80 meets 78. Shelf 120 is attached to bottom shelf 62 where vertical member 64 meets horizontal member 62 and to shelf 112 and at right angles to shelf 112. Shelf 122 is attached to left side 216 and shelf 112, parallel to shelf 120 and at right angles to shelf 112.

Shelf 124 is attached to shelf 112 where 120 meets 112 and to shelf 118 and at right angles to shelf 118. Shelf 126 is attached to shelf 112 where 122 meets 112 and to shelf 118, is parallel to shelf 124 and at right angles to shelf 118.

Figure 3:
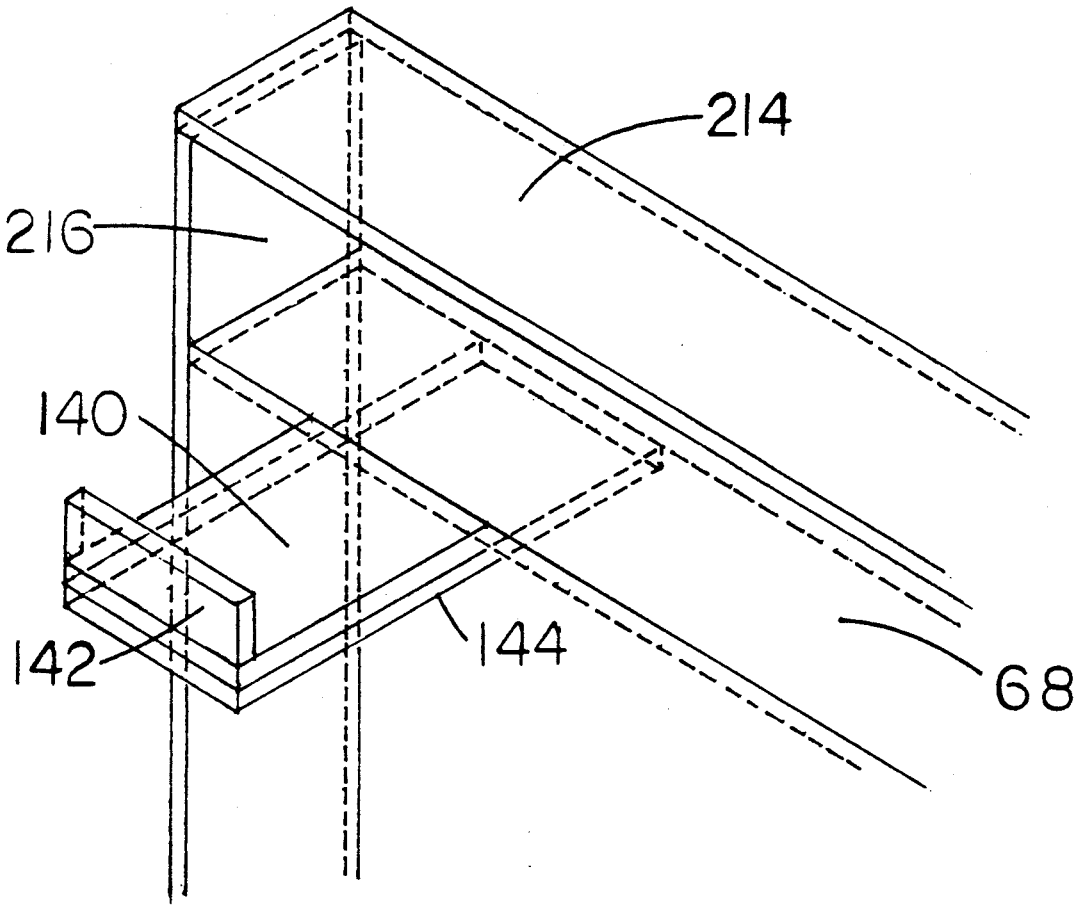
FIG. 3 is an isometric view of an embodiment of the instant invention where the shelves project away from the plane parallel to the rear of the book case.

Referring to FIG. 3, the segment of the book case illustrated therein is composed of a frame with two vertical sides 216 (only one shelf is shown), and two horizontal shelves 214 (only top side is shown) that contain a plurality of shelves that are horizontal: 68 (only one shown). The vertical sides 216 are attached to the horizontal top and bottom shelves 214. The horizontal shelves 68 are attached to the vertical sides 216. Shelf 140 is attached to shelf 68 at right angles to shelf 68 on the same horizontal plane as shelf 68 and is supported by shelf 10 which is also attached to shelf 68. Support member 142 is attached to shelf 140 at right angles to shelf 140. This figure represents just one portion of the entire book case.

Figure 4:
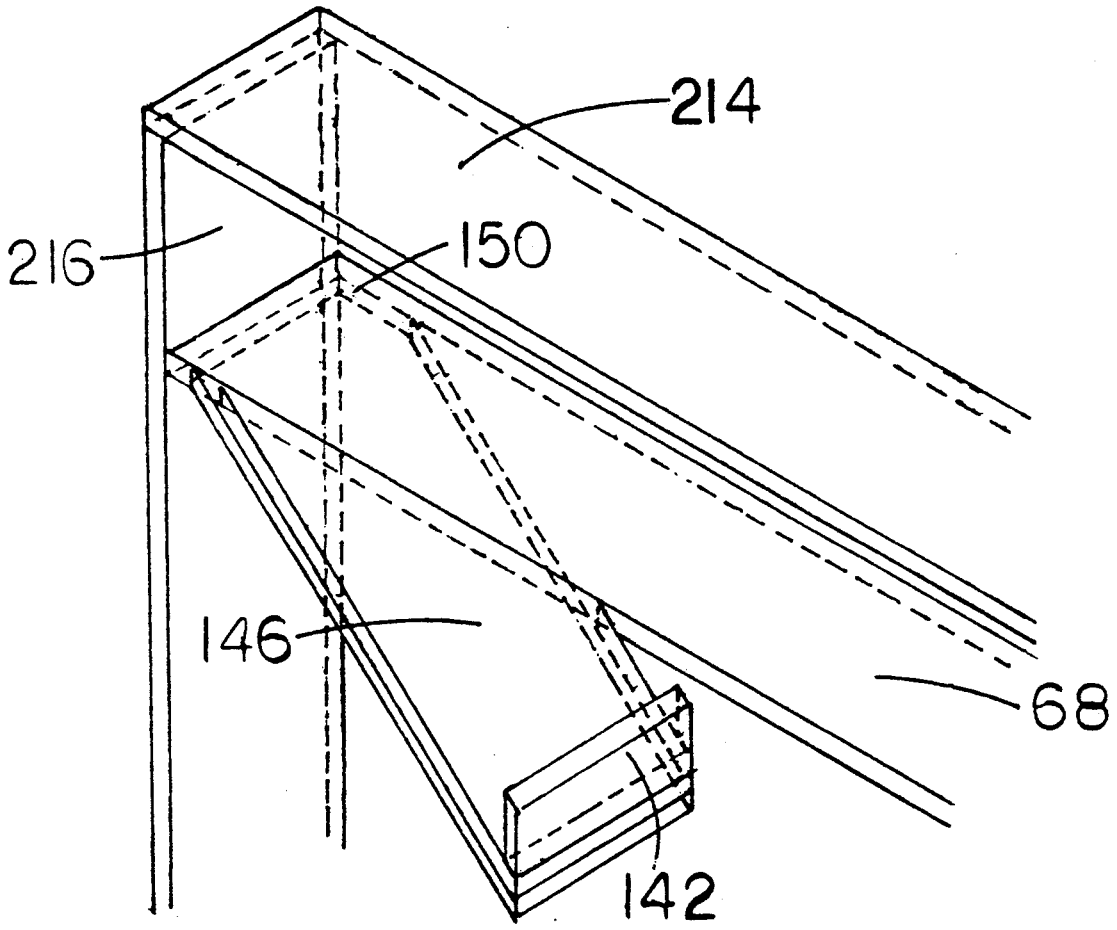
FIG. 4 is an isometric view of an embodiment of the instant invention where the shelves project at an angle of 45 degrees from the plane parallel to the rear of the book case and are horizontal.

Referring to FIG. 4, the segment of the book case illustrated therein is composed of a frame with two vertical sides 216 (only one side is shown), and two horizontal shelves 214 (only top shelf is shown) that contain a plurality of shelves that are horizontal: 68 (only one shown). The vertical sides 216 are attached to the horizontal top and bottom shelves 214. The horizontal shelves 68 are attached to the vertical sides 216. Shelf 140 is attached to shelf 68 at an angle of 45 degrees to shelf 68 on the same horizontal plane as shelf 68 and is supported by shelf 144 which is also attached to shelf 68. Support member 142 is attached to shelf 140 at right angles to shelf 140. This figure represents just one portion of the entire book case.

Figure 5:
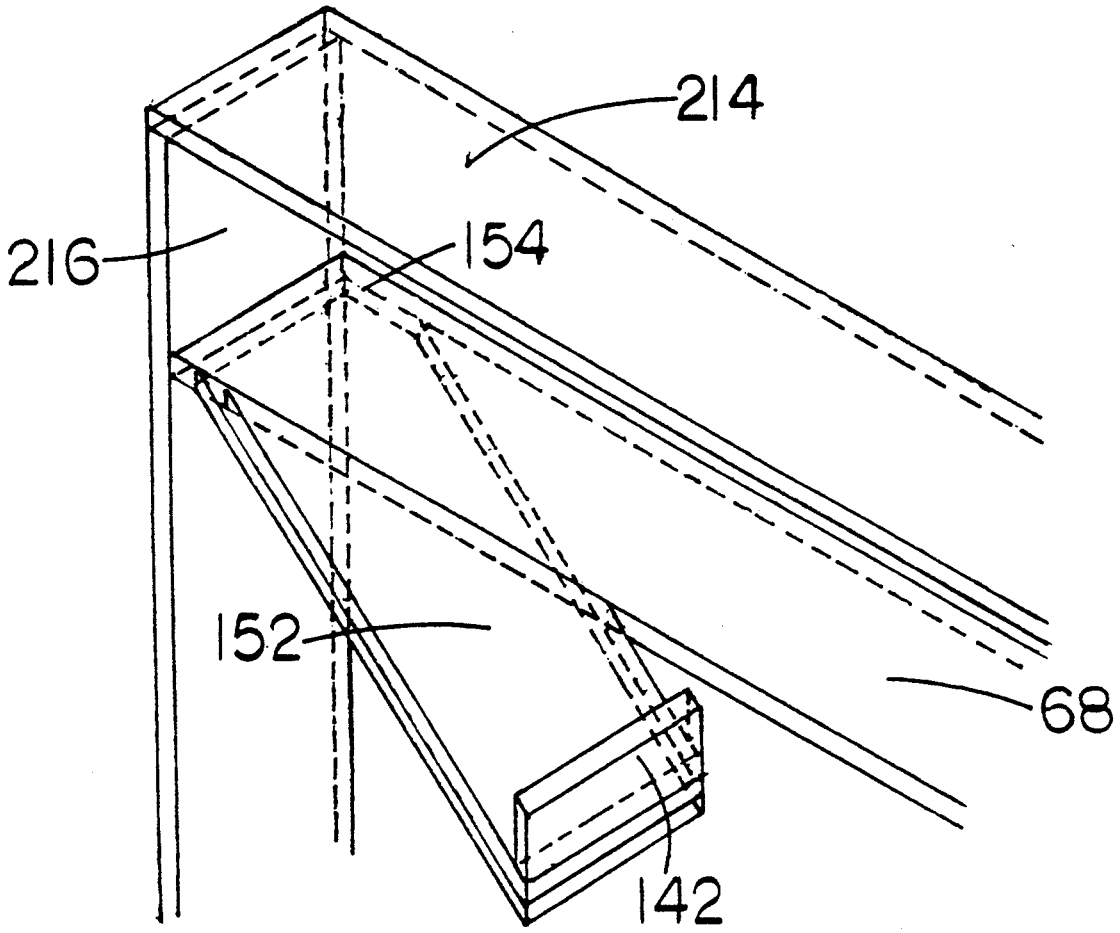
FIG. 5 is an isometric view of an embodiment of the instant invention where the shelves project at an angle between one and 44 degrees away from the plane parallel to the rear of the book case and are horizontal.

Referring to FIG. 5, the segment of the book case illustrated therein is composed of a frame with two vertical sides 216 (only one side is shown), and two horizontal shelves 214 (only top shelf is shown) that contain a plurality of shelves that are horizontal: 68. The vertical sides 216 are attached to the horizontal top and bottom shelves 214. The horizontal shelves 68 are attached to the vertical sides 216. Shelf 152 is attached to shelf 68 at an angle between one and 44 degrees to shelf 68 on the same horizontal plane as shelf 68 and is attached to shelf 68 and supported by shelf 54 which is also attached to shelf 68. Support member 142 is attached to shelf 152 at right angles to shelf 152. This figure represents just one portion of the entire book case.

Figure 6:
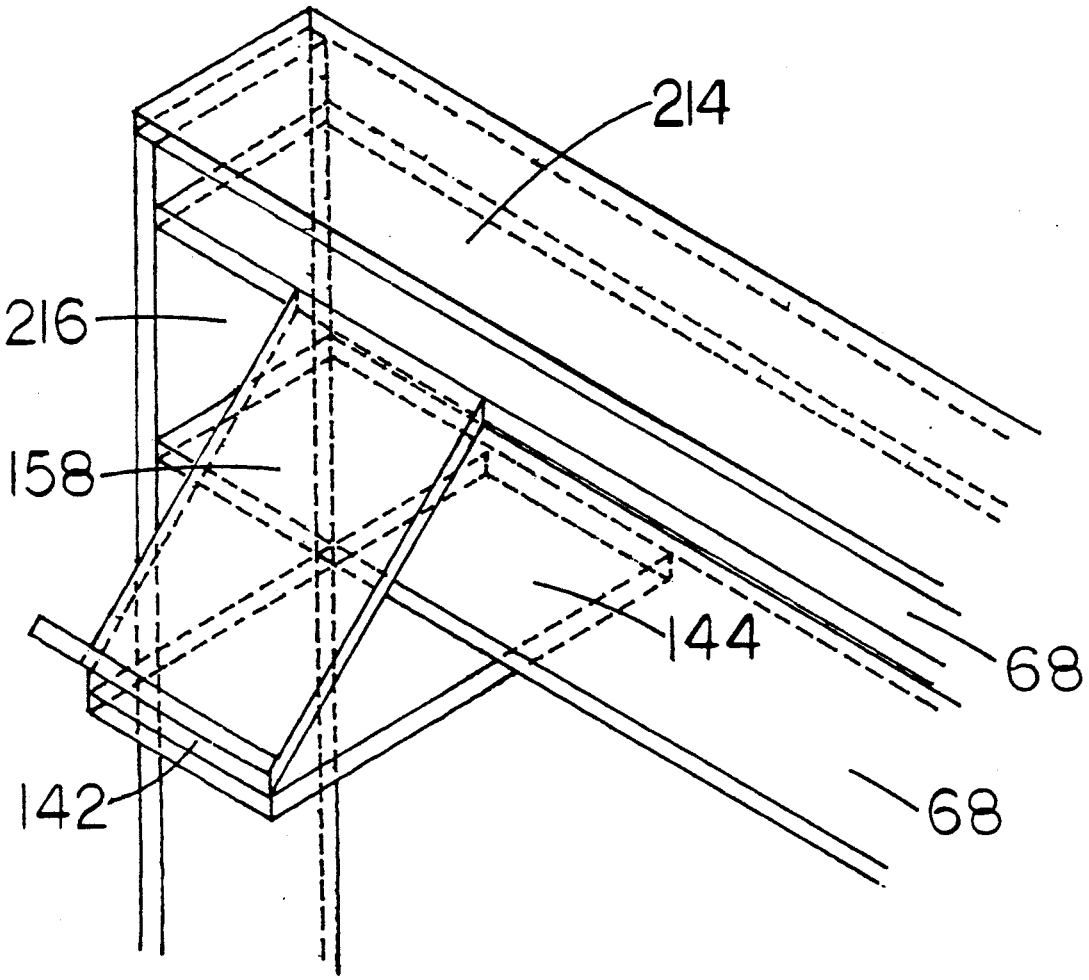
FIG. 6 is an isometric view of an embodiment of the instant invention where the shelves project perpendicular to the plane parallel to the rear of the book case but an angle of 45 degrees from horizontal.

Referring to FIG. 6, the segment of the book case illustrated therein is composed of a frame with two vertical sides 216 (only one shelf is shown), and two horizontal shelves 214 (only top side is shown) that contain a plurality of shelves that are horizontal, 68, that are attached to vertical sides 216. The vertical sides 216 are attached to the horizontal top and bottom shelves 214. Shelf 158 is at an angle of 45 degrees from the horizontal, is at right angles to shelves 68, is attached to shelf 68 and supported by shelf 144 which in turn is attached to shelf 68. Support member 142 is attached to shelf 158 at right angles to shelf 158. This figure represents just one portion of the entire book case.

Figure 7:
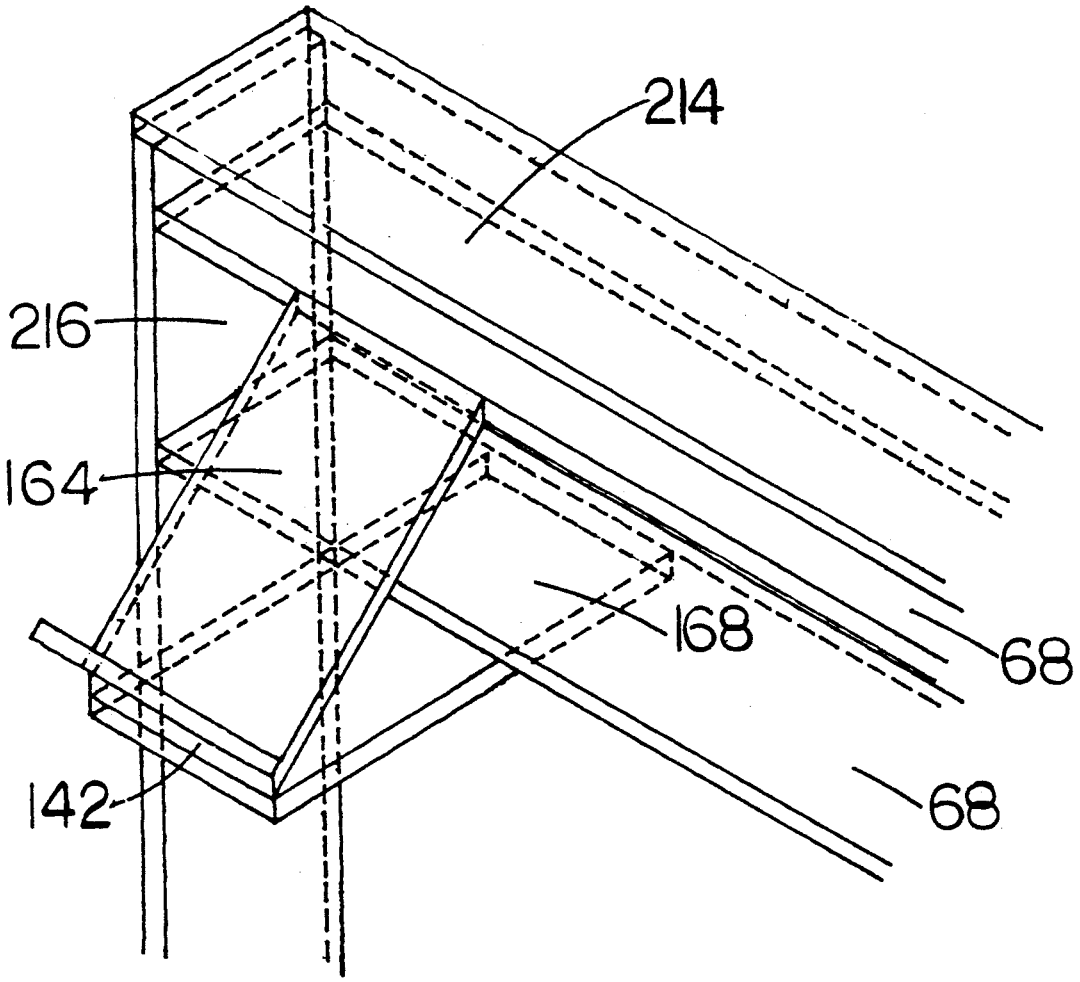
FIG. 7 is an isometric view of an embodiment of the instant invention where the shelves project perpendicular to the plane parallel to the rear of the book case but at an angle between one and 44 degrees from horizontal.

Referring to FIG. 7, the segment of the book case illustrated therein is composed of a frame with two vertical sides 216 (only one side is shown), and two horizontal shelves 214 (only top shelf is shown) that contain a plurality of shelves that are horizontal, 68, that are attached to vertical sides 216. The vertical sides 216 are attached to the horizontal top and bottom shelves 214. Shelf 158 is at an angle between one and 44 degrees from the horizontal, is at right angles to shelves, 68, and is attached to shelf 68 and supported by shelf 144 which in turn is attached to shelf 68. Shelf 142 is attached to shelf 158 at right angles to shelf 158. This figure represents just one portion of the entire book case.

Figure 8:
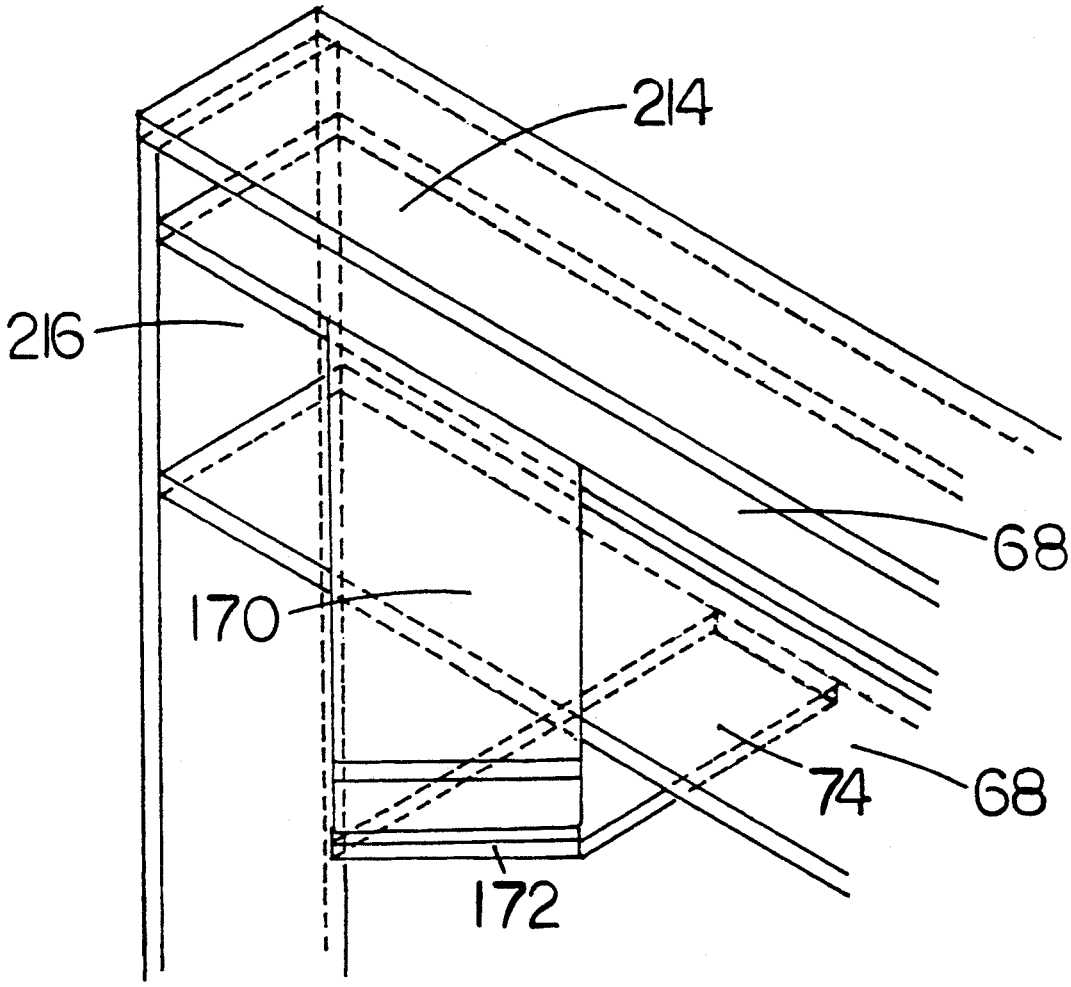
FIG. 8 is an isometric view of an embodiment of the instant invention where the shelves project at an angle of 45 degrees from the plane parallel to the rear of the book case and at an angle of 45 degrees from horizontal.

Referring to FIG. 8, the segment of the book case illustrated therein is composed of a frame with two vertical sides 216 (only one side is shown), and two horizontal shelves 214 (only top shelf is shown) that contain a plurality of shelves that are horizontal, 68, that are attached to the vertical sides 216. The vertical sides 216 are attached to the horizontal top and bottom shelves 214. Shelf 170 is at a 45 degree angle from the horizontal and is at a 45 degree angle from shelves 68, and is attached to shelf 68 and supported by shelf 74 which in turn is attached to shelf 68. Shelf 172 is attached to shelf 170 at right angles to shelf 170. This figure represents just one portion of the entire book case.

Figure 9:
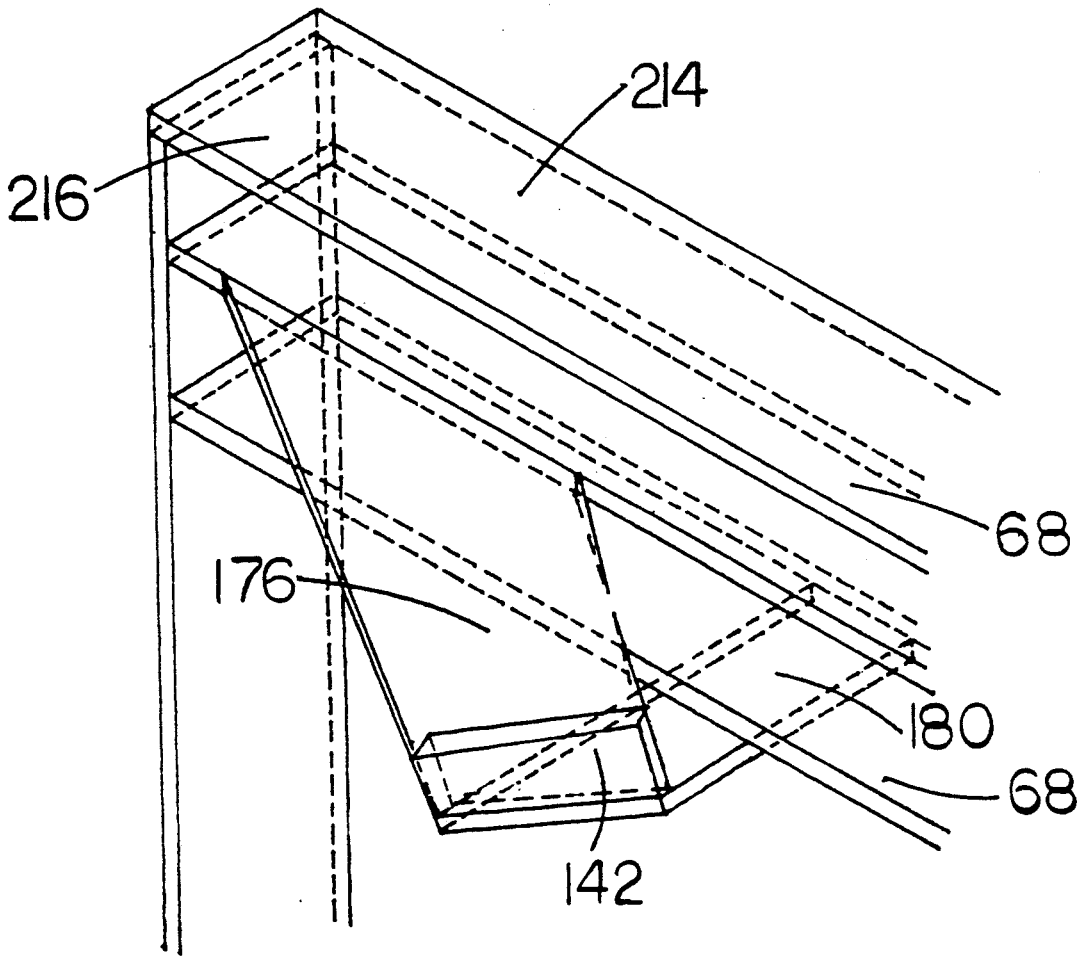
FIG. 9 is an isometric view of an embodiment of the instant invention where the shelves project at an angle between one and 44 degrees from the plane parallel to the rear of the book case and at an angle between one and 44 degree from horizontal.

Referring to FIG. 9, the segment of the book case illustrated therein is composed of a frame with two vertical sides 216 (only one side is shown), and two horizontal shelves 214 (only top shelf is shown) that contain a plurality of shelves that are horizontal, 68, attached to the vertical sides 214. The vertical members 216 are attached to the horizontal top and bottom shelves 214. Shelf 176 is attached to shelf 68 and at an angle between one and 44 degrees from the horizontal and at an angle of between one and 44 degrees in a horizontal plane. Shelf 176 is attached at shelf 68 and is supported by shelf 180 which in turn is attached to shelf 68. Shelf 142 is attached to shelf 176 at right angles to shelf 176. This figure represents just one portion of the entire book case.

Figure 10:
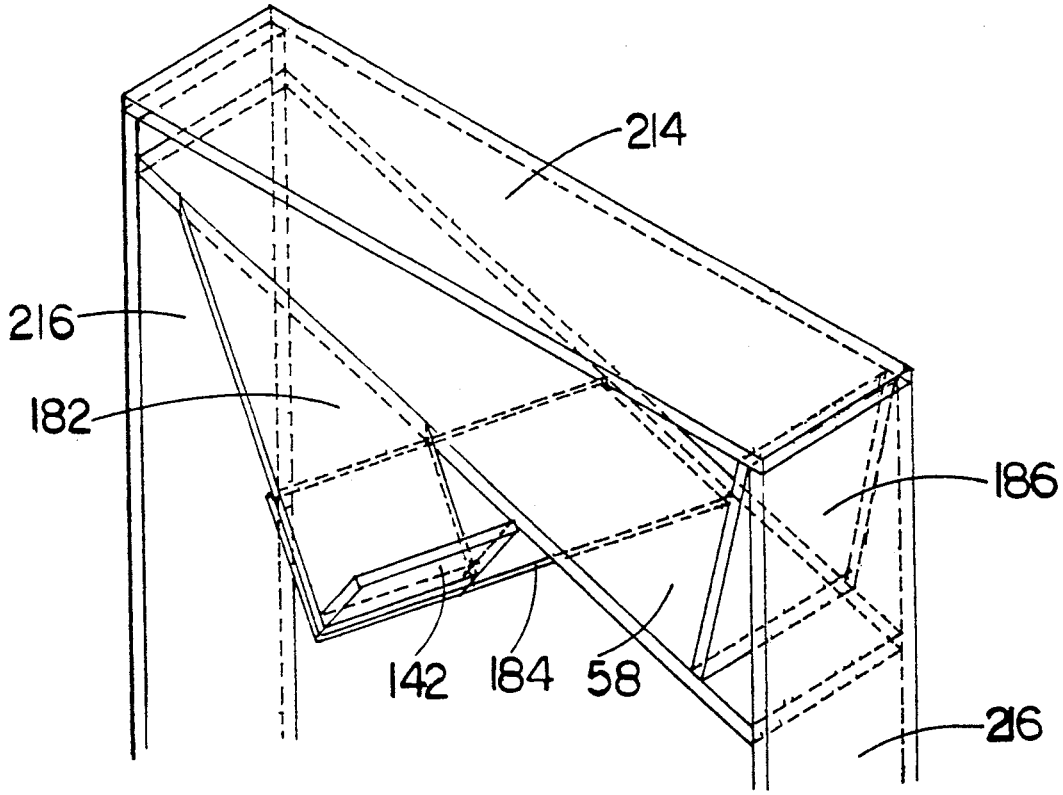
FIG. 10 is an isometric view of an embodiment of the instant invention where the shelves project from shelves that are other than horizontal, and at any angle, right angle, 45 degrees, or any angle from one to 44 degrees, away from such shelves, but in the same plane.

Referring to FIG. 10, the segment of the book case illustrated therein is composed of a frame with two vertical sides 216 (only one side is shown), and two horizontal shelves 214 (only top shelf is shown) that contain a plurality of shelves 68 (only one of which is shown) that are at an angle of from one to 45 degrees from the horizontal). The vertical sides 216 are attached to the horizontal top and bottom shelves 214. The angled shelves 58 are attached to the vertical sides 216. Shelf 182 is at the same angle from the horizontal as shelf 58, but at an angle in the same plane as 58 from one to 90 degrees from shelf 58, is attached to shelf 58 and is supported by shelf 184 which is at the same angle from the horizontal as shelves 58 and 182 and which is also attached to shelf 58. Shelf 142 is attached to shelf 182 at right angles to shelf 182. Shelf 186 is attached to shelf 58 and shelf 214 and is at right angles to shelf 58. This figure represents just one portion of the entire book case.

Figure 11:
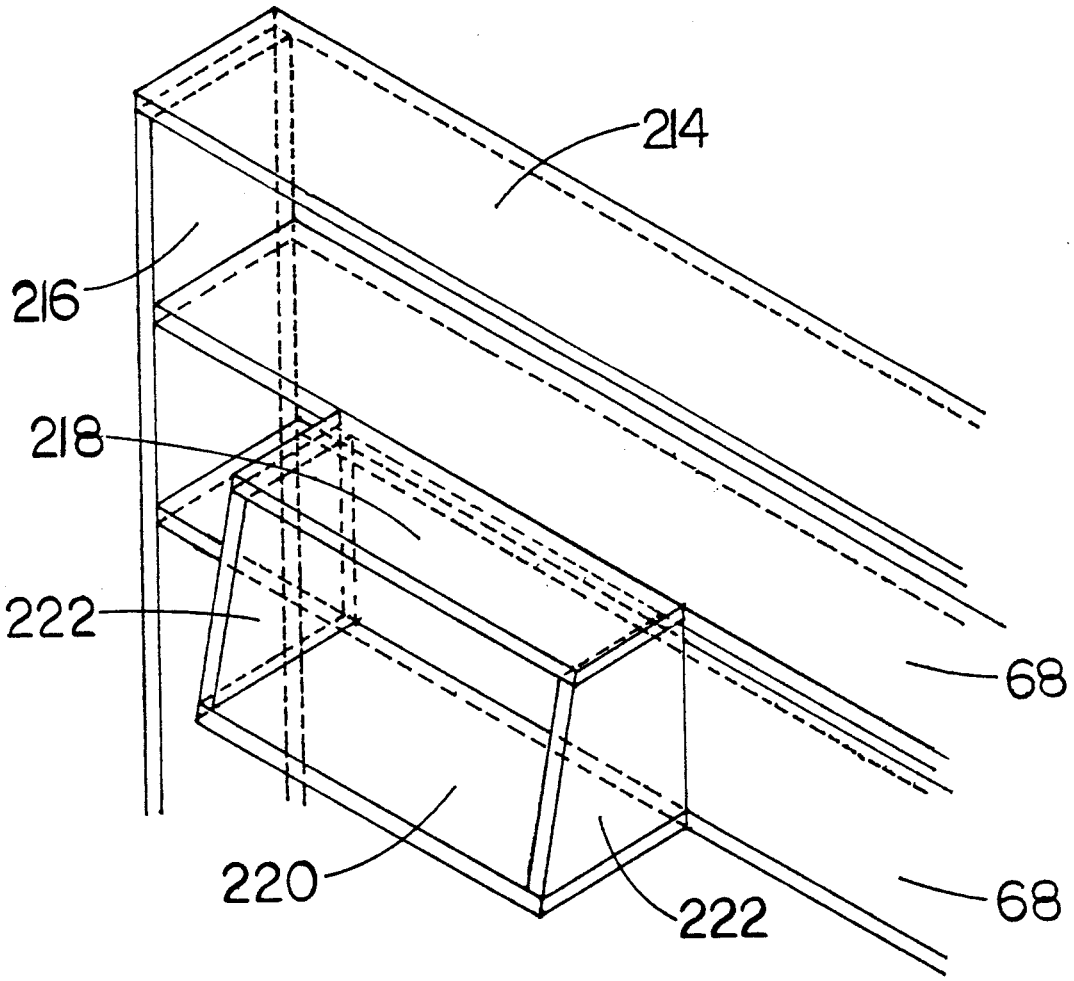
FIG. 11 is an isometric view of an embodiment of the instant invention where the four sides of one shelf section are wider (deeper) than the width of the majority of the shelves, but where the top side is not as deep as the bottom, but both are deeper than the majority of the shelves. Such shelf compartments can have all four sides the same width as well as that which is shown. Such shelf compartments can also be compartments that are at an angle of 45 degrees from the horizontal as well as at any angle from one to 44 degrees from the horizontal.

Referring to FIG. 11, the segment of the book case illustrated therein is composed of a frame with two vertical sides 216 (only one side is shown), and two horizontal shelves 214 (only top shelf is shown) that contain a plurality of shelves 68 (only two of which are shown) that are horizontal. Member 218 is an extension away from the back plane of the book case, is a continuation of upper shelf 68 for only a portion of the length of upper shelf 68. Member 220 is an extension away from the back plane of the book case, is a continuation of lower shelf 68 for the same portion of the length of both shelves 68 as member 218. Two vertical members 222 extend between shelves 218 and 220 the upper dimension of 222 equaling the width of shelf 218 and the lower dimension equaling the width of shelf 220, both 222's being at right angles to shelves 218 and 220. This figure represents just one portion of the entire book case.

I claim:

1. A bookcase, comprising:

a frame including first and second substantially vertical side portions, a substantially horizontal top portion, a substantially horizontal bottom portion;

at least one substantially horizontal shelf adapted to support objects, the at least one substantially horizontal shelf associated with at least one of the side, top and bottom portions;

at least one angled shelf associated with at least one of the side, top, and bottom members and the substantially horizontal shelf; and at least one shelf extension, extending forwardly from one of the at least one substantially horizontal shelf and the at least one angled shelf.

2. The bookcase of claim 1, wherein the at least one shelf extension extends from the at least one substantially horizontal shelf, the at least one shelf extension defines an extension plane, the at least one substantially horizontal shelf defines a horizontal plane, and the extension plane and horizontal plane are coplanar.

3. The bookcase of claim 2, further comprising a support member extending substantially perpendicularly from the at least one shelf extension.

4. The bookcase of claim 1, wherein the at least one shelf extension extends from the at least one substantially horizontal shelf, the at least one shelf extension defines an extension plane, the at least one substantially horizontal shelf defines a horizontal plane, and the extension plane and horizontal plane are not coplanar.

5. The bookcase of claim 4, further comprising a support member extending substantially perpendicularly from the at least one shelf extension.

6. The bookcase of claim 1, wherein the at least one shelf extension extends from the at least one angled shelf, the at least one shelf extension defines an extension plane, the at least one angled shelf defines an angled shelf plane, and the extension plane and angled shelf plane are substantially coplanar.

7. The bookcase of claim 6, further comprising a support member extending substantially perpendicularly from the at least one shelf extension.

8. The bookcase of claim 1, further comprising a support member extending substantially perpendicularly from the at least one substantially horizontal shelf.

9. The bookcase of claim 1, further comprising a support member extending substantially perpendicularly from the at least one angled shelf.

10. A bookcase, comprising:

a frame including first and second substantially vertical side portions, a substantially horizontal top portion, a substantially horizontal bottom portion;

at least one substantially horizontal shelf adapted to support objects, the at least one substantially horizontal shelf associated with at least one of the side, top and bottom portions, the at least one substantially horizontal shelf defining first and second ends and a center portion;

at least one angled shelf associated with at least one of the side, top, and bottom members and the substantially horizontal shelf, the at least one angled shelf defining first and second ends and a center portion; and at least one support member extending substantially perpendicularly from one of the center portion of the at least one substantially horizontal shelf and the center portion of the at least one angled shelf.

11. The bookcase of claim 10, wherein the at least one angled shelf comprises first and second angled shelves arranged at first and second angles, respectively, the first angle different than the second angle.

* * * * *